United States Patent [19]

Thorpe et al.

[11] Patent Number: 4,657,503

[45] Date of Patent: Apr. 14, 1987

[54] BURNER SYSTEM

[75] Inventors: Merle L. Thorpe, Hopkinton; Kenneth P. Hanson, Penacook, both of N.H.

[73] Assignee: Thorpe Corporation, Concord, N.H.

[21] Appl. No.: 763,818

[22] Filed: Aug. 8, 1985

[51] Int. Cl.[4] ..... F23D 15/00

[52] U.S. Cl. ..... 431/158; 431/243

[58] Field of Search ..... 431/242, 243, 244, 158, 431/207, 215, 345, 11

[56] References Cited

U.S. PATENT DOCUMENTS

| | | | |
|---|---|---|---|
| 1,106,965 | 8/1914 | Palmer et al. | 431/243 |
| 1,800,617 | 4/1931 | Forster | 431/244 |
| 2,876,831 | 3/1959 | Knight | 431/158 |
| 2,920,691 | 1/1960 | Henwood et al. | 431/158 X |
| 3,096,812 | 7/1963 | Kervin | 431/158 |
| 3,251,394 | 5/1966 | Thorpe . | |
| 3,926,544 | 12/1976 | Thorpe . | |

*Primary Examiner*—James C. Yeung

[57] ABSTRACT

An internal combustion burner system includes a combustion chamber that has spaced plate type sidewalls and peripheral wall structure secured to the sidewalls. Housing structure surrounds and cooperates with the peripheral chamber wall structure to define flow paths that extend around the perimeter of the combustion chamber. An air-fuel mixture is fed through a housing inlet and along the perimeter flow paths for cooling the peripheral wall of the combustion chamber and then into the combustion chamber through flame stabilizer ports. The air-fuel mixture is burned in the combustion chamber, and the resulting combustion products are discharged from the chamber in one or more high velocity jets. During burner operation, the uncooled combustion chamber sidewalls are typically red hot and flex to accommodate thermal expansion forces while the peripheral walls of the chamber provide a stable peripheral frame that is regeneratively cooled by the air-fuel mixture.

21 Claims, 9 Drawing Figures

FIG 1
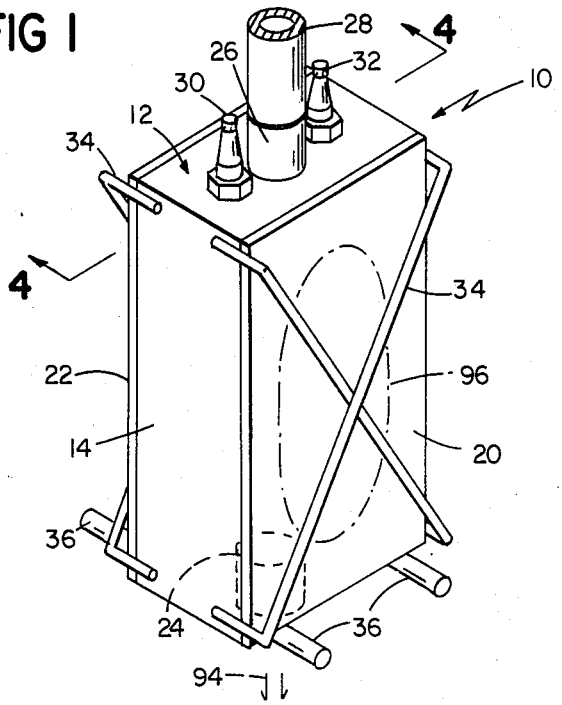
FIG 9
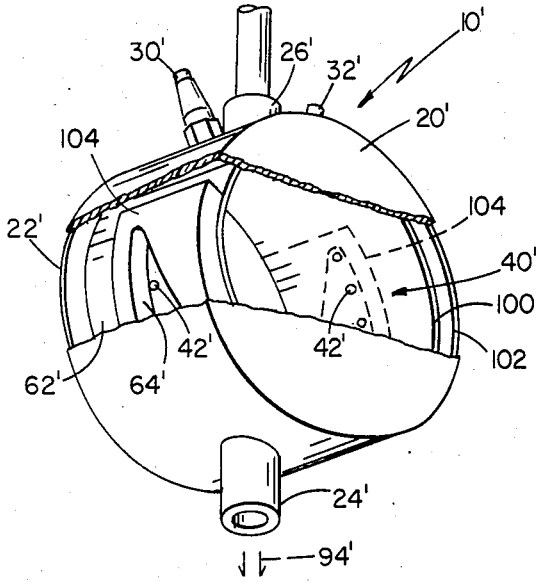
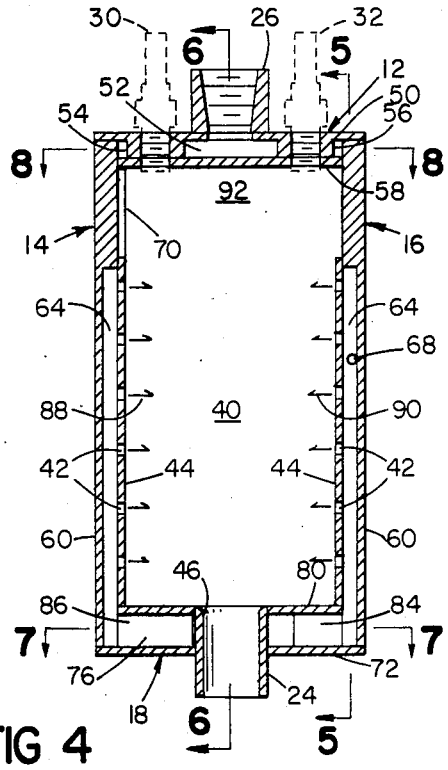
FIG 4
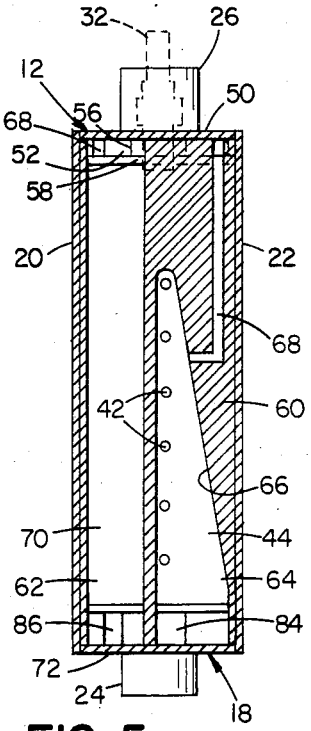
FIG 5
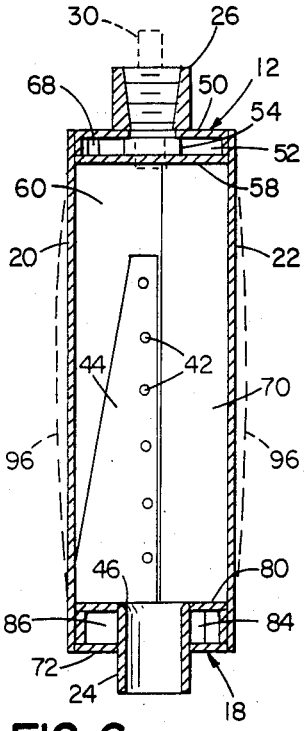
FIG 6
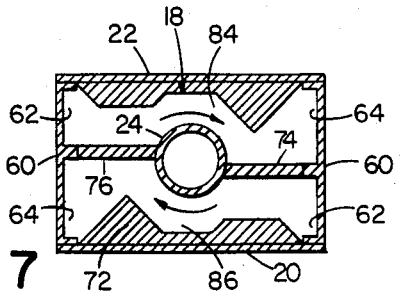
FIG 7
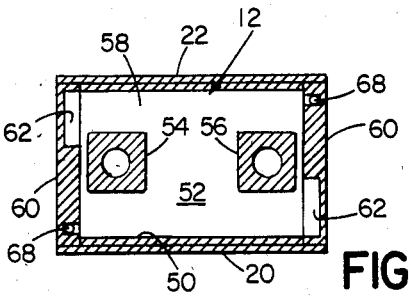
FIG 8

BURNER SYSTEM

This invention relates to burner systems, and more particularly to burner systems of the type in which the combustion process is completed within the combustion chamber and one or more high velocity gets of combustion products is produced, and to portable burner systems of the internal combustion type that are particularly useful for thermally treating or removing foreign material from structural surfaces. Burner systems in accordance with the invention are improvements on the burner system disclosed in U.S. Pat. Nos. 3,251,394 and 3,926,544.

In accordance with the invention there is provided an internal combustion burner system that includes combustion chamber defining structure that has spaced plate type sidewalls and peripheral structure secured to the sidewalls. The peripheral structure includes flow paths that extend around the perimeter of the combustion chamber and provide communication between an air-fuel mixture inlet and flame stabilizer type chamber inlet ports. A burner air-fuel mixture is fed through the inlet and along the perimeter flow paths for regeneratively cooling the peripheral wall structure of the combustion chamber and then into the combustion chamber through the flame stabilizer ports. Ignition means is provided for igniting the air-fuel mixture in the combustion chamber, and the resulting combustion products are discharged from the chamber through discharge nozzle structure in one or more high velocity jets. During operation, the sidewalls of the combustion chamber structure are maintained at elevated temperature and provide a stable high temperature environment in the combustion chamber into which the air-fuel mixture is introduced for ignition and combution within the chamber. Those uncooled combustion chamber sidewalls are typically red hot (enhancing flame stabilization and high intensity combustion) and flex to accommodate thermal expansion forces while the peripheral walls of the chamber provide a stable peripheral frame that is regeneratively cooled by the air-fuel mixture, such that bellows type compensation and the like employed in tubular type prior art burners is not reguired.

In preferred embodiments, the chamber inlet ports are disposed in two opposed arrays for flowing converging streams of the air-fuel mixture into the lower portion of the combustion chamber adjacent the discharge orifice region while providing a relatively guiescent zone in the upper portion of the combustion chamber adjacent the ignition means. The peripheral wall structure includes metal base member structure in which flow channels are formed and metal plate structure welded to the base member structure, the metal plate structure being disposed over and closing the flow channels so that one surface of the metal plate structure forms a combustion chamber surface and the opposite surface of the metal plate structure forms a flow channel surface. Preferrably, the combustion chamber sidewall area is at least 40% of total chamber surface area; and the flow paths are dimensioned to provide a pressure drop of at least about five psi between the housing inlet and the combustion chamber.

In particular embodiments, the peripheral structure includes metal base member structure in which flow channels are formed and metal plate structure welded to the base member structure, the metal plate structure being disposed over and closing the flow channels, with one surface of the metal plate structure forming a combustion chamber surface and the opposite surface of the metal plate structure forming a flow channel surface. The flow paths extend symmetrically in opposite directions about the periphery of he combustion chamber, pass in opposite directions along opposite sides of the discharge nozzle(s) and into flame stabilizer manifold chambers. The peripheral wall structure may be of various configurations, including cylindrical, elliptical, polygonal (prismatic), or combinations thereof. In rectangular configurations, the peripheral wall structure includes parallel top and bottom surfaces and parallel opposed end wall surfaces with flame stabilizer structure in each end wall. The sidewalls are thin, flexible sheets of high temperature alloy such as Inconel, and are at least 1000° F. hotter than the peripheral wall structure during operation of the combustion system.

During burner operation, flame stabilization occurs adjacent the chamber inlet ports. The volumetric heat release of the burner is of substantial magnitude and the burner generates combustion products which are discharged in a high velocity (at least about 2500 feet per second) jet or swath. The burner system starts and turns up easily (without the erratic detonation action of prior portable burner systems) due in part to the relatively guiescent air-fuel mixture zone adjacent the igniter structure and to the increased flame stablization area provided by the multiport injectors. Burners in accordance with the invention appear to run hotter and produce more complete combustion, giving higher thermal efficiency and higher jet heating rates. In a stippling application, brush type (multiple discharge orifice) burners in accordance with the invention stipple at a rate that is approximately $\frac{1}{3}$ faster than prior burners of the brush type that use the same amount of air and fuel.

The invention provides lightweight, portable and efficicnt burner arrangements which produce a high velocity discharge of combustion products that are particularly useful for removing foreign substances from or treating structural surfaces. In connection with the treatment of road pavement surfaces, for example, the high velocity discharge of combustion products acts with erosive volatilizing, flaking and burning action to remove foreign substances without damage to the pavement material. The jet of combustion products from the burner is also useful for removing debris from a pavement crack or groove in a heating and cleaning operation, and also for conditioning the surfaces of the crack or groove for sealing.

Other features and advantages of the invention will be seen as the following description of particular embodiments progresses, in conjunction with the drawings, in which:

FIG. 1 is a perspective view of burner apparatus in accordance with the invention;

FIG. 4 is a sectional view taken along the line 4—4 of FIG. 1;

FIGS. 5–8 are sectional views taken along the lines 5—5, 6—6, 7—7, and 8—8 respectively of FIG. 4; and FIG. 9 is a perspective view of another burner system (with parts broken away) in accordance with the invention.

DESCRIPTION OF PARTICULAR EMBODIMENT

Figure 2:
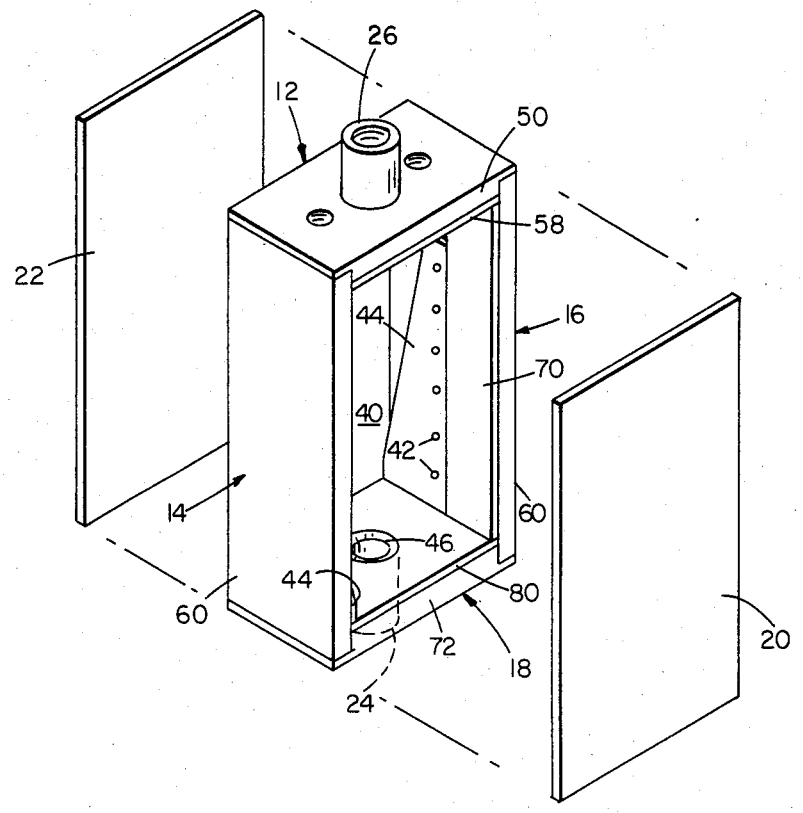
FIG. 2 is an exploded perspective view of components of the burner of FIG. 1.

The burner unit shown in FIG. 1 has a prismatic housing assembly 10 of rectangular configuration that is about eighteen centimeters in height, about 9.5 centimeters in width, and about five centimeters in depth. Housing assembly 10 includes rectangular top (rear end) flow channel assembly 12, parallel opposed end wall flow channel assemblies 14, 16, bottom (front end) flow channel assembly 18, and parallel opposed side plates 20, 22. Extending downwardly from front end flow channel assembly 18 is nozzle 24 which defines a combustion products outlet. Coupling 26 is secured to top (rear end) flow channel assembly 12 and receives 1.25 centimeter inner diameter conduit 28 through which an air-fuel mixture is supplied at a pressure of about twenty-three psig, air being supplied from a source at a nominal pressure of seventy psig and propane being supplied from a source at a nominal pressure of eighteen psig through a jet injector of the type shown in U.S. Pat. No. 3,926,544. Ignition means in the form of spark plugs 30, 32, are mounted on either side of coupling 26 and extend through rear end flow channel assembly 12 into the combustion chamber 40. A protective array of guard wires 34 extends across each side plate 20, 22; and wear rods 36 secured to front end flow channel assembly 18 project beyond side plates 20, 22 to space and protect the burner unit from the surface on which the unit is being used.

Figure 3:
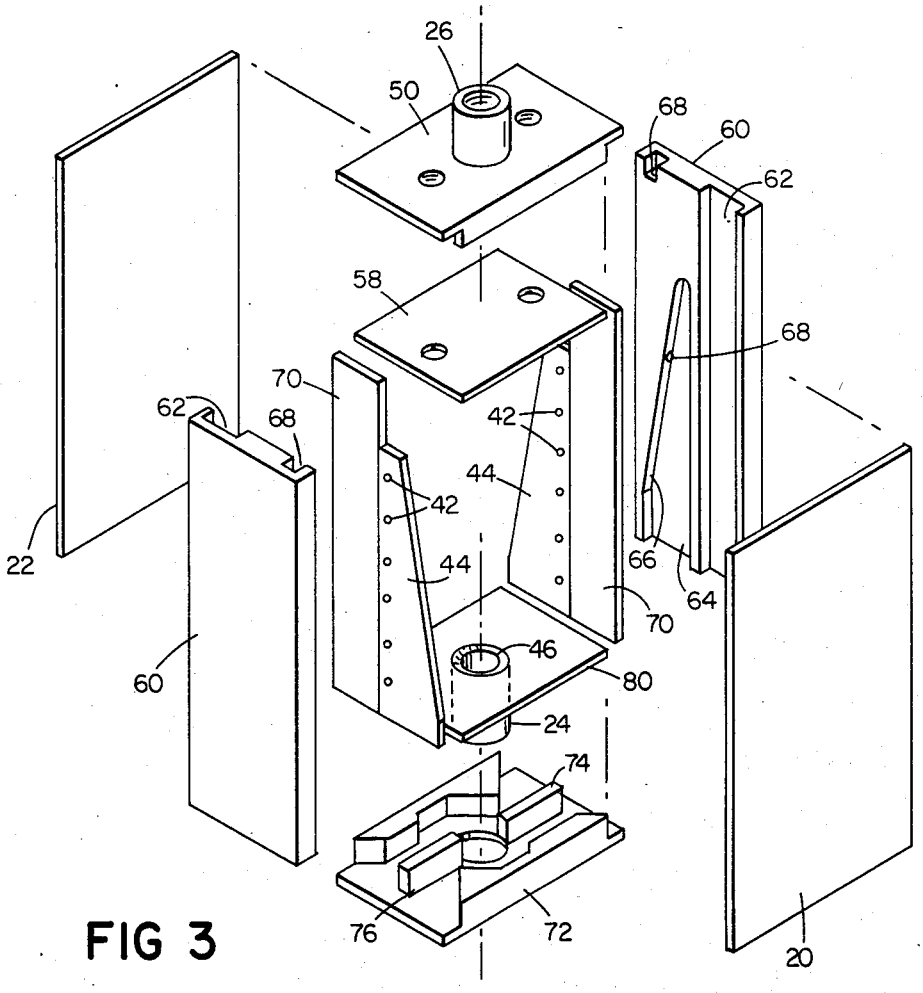
FIG. 3 is a further exploded perspective view of components of the burner of FIG. 1.

Further details of the burner unit may be seen with reference to the perspective view of FIG. 2, the exploded view of FIG. 3, and the sectional views of FIGS. 4–8. The four flow channel assemblies 12, 14, 16 and 18 are welded together in rectangular frame configuration as shown in FIG. 2 to define (with side plates 20, 22) a combustion chamber 40. An array of six flame stabilizer input ports 42 of about ¼ centimeter diameter and spaced about one centimeter apart is provided in plate 44 of each end wall flow channel assembly 14, 16; and a discharge port 46 of about two centimeters diameter that communicates with nozzle 24 is provided in the bottom wall flow channel assembly 18, providing a chamber inlet/outlet port area ratio of about 0.5. (Another embodiment with the same combustion chamber configuration employs two opposed rows of six inlet ports 42' that are about 0.44 centimeter in diameter and a two centimeter diameter outlet port 46', providing a chamber inlet/outlet port area ratio of about 0.6.)

Each flow channel assembly includes a base member of Inconel (the base member of front end assembly 18 having a thickness of about 1.25 centimeter, and the base members of the top and side flow channel assemblies having about 0.8 centimeter thicknesses) in which flow channels have been machined, and sheet structure of 0.16 centimeter thick Inconel that is welded to each base member and that closes the flow channel or channels on the combustion chamber side of the assembly. More specifically, the top assembly 12 includes base member 50 in which a flow channel 52 has been machined (leaving spark plug bosses 54, 56—as indicated in FIG. 8), flow channel 52 being closed by 0.16 centimeter thick Inconel plate 58 that is welded to base member 50 and bounds the flow channels in assembly 12 on the combustion chamber side. Each end wall flow channel assembly 14, 16 includes a base member 60 in which has been machined channel 62 that has a width of about 1.6 centimeter and extends the length of member 60 to form a through channel, and a distribution channel 64 of triangular configuration with an entrance width of about 2.5 centimeters, an edge 66 tapering at 10° angle and a length of about six centimeters and auxiliary cooling channel 68. Strip plate 70 is welded to close channel 62 and triangular plate 72 in which chamber ports 44 are preformed is welded to close the triangular distribution channel 64. The front end assembly 18 includes base member 72 with Inconel nozzle 24 and divider webs 73, 74 welded to it to define two flow paths 84, 86 that are on opposite sides of nozzle 24. The configured walls of the channel in front end member 72 are shaped to provide a high cooling flow velocity around nozzle 24. Plate 80 is welded to base member 72 to close those channels.

These four flow channel assemblies are assembled as indicated in FIG. 2 and welded at the intersecting corners of the combustion chamber 40 and at their external joints to form a peripheral housing structure with symmetrical flow channels that extend from inlet coupling 26 in either direction around the spark plug bosses 54, 56 to the flow channels 62 downwardly to front end channels 76, 78 around the nozzle 24 and into the distribution channels 64 for upward flow through the tapered passages and discharge through the flame stabilizer inlet orifices 42 in the combustion chamber 40 and through auxiliary cooling channels 68.

The 0.16 centimeter thick Inconel side plates 20, 22 are then welded to the peripheral flow channel frame and provide uncooled side boundaries of the combustion chamber 40.

In operation, an air propane mixture at a handle pressure of about thirty-five psig, is flowed through pipe conduit 28 into the inlet chamber 52, then divided for symmetrical flow downwardly along end wall passags 62, 68, the major flow flowing through passages 62, then through front end passages 84, 86 (in opposite directions as indicated by arrows in FIG. 7), and then upwardly into manifold chambers 64 for discharge through flame stabilizer ports 42 in opposed streams 88, 90 into the combustion chamber 40, and creating a relatively guiescent fuel mixture zone 92 in the upper portion of chamber 40 adjacent the sparkplugs. To initiate combustion, one of the spark plugs 30, 32 is energized to ignite the mixture in chamber 40 (the two plugs being utilized to provide flow passage symmetry and also redundant ignition capability). Combustion of the air/fuel mixture is stabilized around each injection port 42 and as the side plates 20, 22 heat to an elevated temperature, they tend to bow outwardly as indicated by the dotted lines in FIG. 6 and remain in that bowed condition. When the burner is in full operation, the central portion of each side wall is at a red heat (as indicated diagrammatically at 96 in FIG. 1) and provides a high temperature area that further contributes to the stability of the combustion environment. Complete combustion of the air/fuel mixture occurs in combustion chamber 40 at a chamber pressure of about five psig and the resulting combustion products pass through the discharge orifice 46 and nozzle 24 in a high velocity jet 94 that has a velocity of about 2500 feet per second and a temperature of about 3000° F. (It will be apparent that the temperature of jet 94 can be reduced as desired with dilution.)

In this combustion unit, stable and complete combustion operation conditions are obtained with a similar combustion chamber pressure (five psig) and air/fuel mixture flow rate (fifty scfm) as in tubular combustion units of the type shown in the above mentioned U.S. Pat. No. 3,926,544. The combustion unit also operates satisfactorily with higher and lower flow rates. This burner efficiently removes foreign substances from asphalt and concrete road pavement without significant removal of pavement material. It is particularly useful in rapidly and effectively removing traffic control lines from pavement surfaces and also in cleaning random pavement cracks preparatory to repair.

In use, the combustion unit is manually supported by the operator and the jet 94 of combustion products provides upward thrust against the force of gravity so that the combustion unit 10 essentially is floating and maintains itself spaced from the pavement surface. The operator merely guides the combustion unit to direct the jet 94 to the area where the line of paint to be removed or the crack to be cleaned is located. The jet 94 impinges directly on the material to be removed, and causes rapid erosion, volatilization, flaking and/or combustion of the traffic control line or other material in the path of the jet 94. The velocity of the jet removes debris and the volatilized combusted material from the site, and provides a clean pavement surface that needs no after-treatment. The protective wire array and wear rods (not shown in FIGS. 4–8) provide protection for the hot side walls 20, 22 both during and between intervals of burner operation.

A second combustion chamber unit shown in FIGS. 9 has a combustion chamber 40' defined by cylindrical chamber wall 100 and side plates 20', 22'; and a cylindrical peripheral housing wall 102 with divider structures 104 interposed between walls 100, 102 that define symmetrical cooling flow paths for the air-fuel mixture for flow around the chamber periphery and nozzle 24' to converging manifold 64' for introduction into combustion chamber 40' through the flame stabilizer ports 42' for combustion and discharge of a jet 94' of combustion products through nozzle 24'. (Guard structure similar to wire array 34 and rods 36 is preferably also employed with this burner unit). Other burner unit construction may vary the shape of the combustion chamber and the number of discharge ports. In these burner units, the peripheral frame structure is cooled by flow of the air-fuel mixture while the uncooled combustion chamber walls 20, 22 (20', 22') deflect outwardly in thermal expansion, with their central portions 90 becoming red hot, and providing large high temperature surface areas that contribute to maintaining the stability of the combustion environment.

While particular embodiments of the invention have been shown and described, other embodiments will be apparent to those skilled in the art, and therefore it is not intended that the invention be limited to the disclosed embodiments or to details thereof, and departures may be made therefrom within the spirit and scope of the invention.

What is claimed is:

1. An internal combustion burner system comprising:

structure defining a combustion chamber including spaced, opposed, plate type, planar, uncooled sidewalls and peripheral structure secured between said sidewalls and extending around the perimeter of said combustion chamber, said sidewalls being of thin flexible high temperature sheet material and being free to flex outwardly to accommodate thermal stresses during operation of the combustion system, said peripheral structure including means defining housing inlet port structure, means defining chamber inlet port structure, means defining perimeter flow paths that extend around the perimeter of said combustion chamber and provide communication between said housing inlet port structure and said chamber inlet port structure, and discharge orifice structure secured to said peripheral structure for providing an outlet for combustion products from said combustion chamber, and means for feeding an air-fuel mixture through said housing inlet port structure for flow along said perimeter flow paths for cooling said peripheral structure of said combustion chamber and said discharge orifice structure and then into the combustion chamber through said chamber inlet port structure, the air-fuel mixture being burned in said combustion chamber and the resulting combustion products being discharged from said chamber in one or more high velocity jets through said discharge orifice structure such that during operation, said spaced plate type sidewalls of said combustion chamber are at elevated temperature and provide a stable high temperature combustion chamber environment while the peripheral walls of said chamber provide a stable peripheral chamber frame that is regeneratively cooled by said air-fuel mixture.

2. The system of claim 1 wherein said flow path defining structure includes metal base member structure in which flow channels are formed and metal plate structure welded to said base member structure, said metal plate structure being disposed over and closing said flow channels, one surface of said metal plate structure forming a combustion chamber surface and the opposite surface of said metal plate structure forming a flow channel surface.

3. The system of claim 1 wherein said flow paths extend symmetrically in opposite directions about the periphery of said combustion chamber, and said flow paths pass along opposite sides of said discharge orifice structure.

4. The system of claim 1 wherein said flow path defining structure includes structure defining flame stabilizer manifold chambers that provide communication between said flow paths and said chamber inlet port structure.

5. The system of claims 1 wherein said housing inlet port structure is on the side of said combustion chamber opposite said discharge orifice structure.

6. The system of claim 1 wherein said combustion chamber sidewalls are sheets of material that has stability at temperatures of at least 1000° F.

7. The system of claim 1 wherein said combustion chamber sidewalls are of high temperature alloy material.

8. The system of claim 1 wherein said combustion chamber sidewall area is at least 40% of total chamber surface area.

9. The system of claim 1 wherein said flow path defining structure provides a pressure drop of at least five psi between said housing inlet port structure and said chamber inlet port structure.

10. The system of claim 1 and further including guard structure for said sidewalls of said combustion chamber.

11. The system of claim 1 wherein said combustion chamber has a lower portion adjacent said discharge orifice region and said chamber inlet ports are disposed in two opposed arrays for flowing streams of the air-fuel mixture into said combustion chamber lower portion and a relatively guiescent zone is provided in the upper portion of said combustion chamber adjacent said ignition means.

12. The system of claim 11 wherein said peripheral wall structure is of cylindrical configuration.

13. The system of claim 11 wherein said peripheral wall structure is of prismatic configuration.

14. The system of claim 13 wherein said peripheral wall structure includes parallel top and bottom structures and parallel opposed end wall structures, and said chamber inlet port structure is in said opposed end wall structures.

15. The system of claim 14 wherein said peripheral structure includes metal base member structure in which flow channels are formed and metal plate structure welded to said base member structure, said metal plate structure being disposed over and closing said flow channels one surface of said metal plate structure forming a combustion chamber surface and the opposite surface of said metal plate structure forming a flow channel surface.

16. An internal combustion burner system comprising spaced, opposed, plate type, planar, uncooled sidewalls and peripheral wall structure secured between said sidewall to define a combustion chamber, said sidewalls being of thin flexible high temperature sheet material and being free to flex outwardly to accommodate thermal stresses during operation of the combustion system, air-fuel mixture inlet means, chamber inlet orifice means and chamber exhaust orifice means in said peripheral wall structure, means in said peripheral wall structure defining air-fuel mixture flow paths that extend around the perimeter of said combustion chamber from said inlet means to said chamber inlet orifice means for cooling said peripheral wall structure, means for supplying an air fuel mixture to said inlet means, and ignition means for igniting said air-fuel mixture in said combustion chamber and producing combustion products for discharge from said combustion chamber through said exhaust orifice means.

17. The system of claim 16 wherein said combustion chamber has an upper portion adjacent said ignition means and a lower portion adjacent said dishcarge orifice region, said chamber inlet orifice means includes two sets of inlet ports disposed in two opposed arrays for flowing streams of the air-fule mixture towards each other into the lower portion of said combustion chamber so that a relatively guiescent zone is provided in the upper portion of said combustion chamber.

18. The system of claim 17 wherein said peripheral wall structure includes metal base member structure in which flow channels are formed and metal plate structure welded to said base member structure, said metal plate structure being disposed over and closing said flow channels, one surface of said metal plate structure forming a combustion chamber surface and the opposite surface of said metal plate structure forming a flow channel surface.

19. The system of claim 18 wherein said ignition means includes two ignition devices symmetrically located on either side of said inlet means, and said air-fuel mixture flow paths extend symmetrically in opposite directions about said combustion chamber.

20. The system of claim 19 and further including guard structure for said combustion chamber sidewalls.

21. An internal combustion burner system comprising spaced plate type sidewalls and peripheral wall structure secured to said sidewalls to define a combustion chamber, said sidewalls being of thin flexible high temperature sheet material and being free to flex outwardly to accommodate thermal stresses during operation of the combustion system, the area of said chamber walls being at least 40% of the total chamber surface area, air-fuel mixture inlet means, chamber inlet orifice means and chamber exhaust orifice means in said peripheral wall structure, said chamber inlet orifice means including two sets of inlet ports disposed in two opposed arrays for flowing streams of the air-fuel mixture towards each other into said combustion chamber, said peripheral wall structure including metal base member structure in which flow channels are formed, metal plate structure welded to said base member structure, said metal plate structure being disposed over and closing said flow channels, one surface of said metal plate structure forming a combustion chamber surface and the opposite surface of said metal plate structure forming a flow channel surface, said flow channels extending around the perimeter of said combustion chamber from said inlet means to said chamber inlet orifice means for cooling said peripheral wall structure, means for supplying an air fuel mixture to said inlet means, and ignition means for igniting said air-fuel mixture in said combustion chamber and producing combustion products for discharge from said combustion chamber through said exhaust orifice means, said ignition means including two ignition devices symmetrically located on either side of said inlet means, and said air-fuel mixture flow paths extending symmetrically in opposite directins about said combustion chamber; said flow path defining structure providing a pressure drop of at least five psi between said housing inlet and said chamber inlet orifice means, and flow divider structure in said peripehral flow path defining means, said flow divider structure providing flow in opposite directions on opposite sides of said exhaust orifice means.

* * * * *